United States Patent [19]

Bates

[11] Patent Number: 4,900,357

[45] Date of Patent: Feb. 13, 1990

[54] INJECTION OF SUBSTANCES INTO HIGH TEMPERATURE LIQUIDS

[75] Inventor: Kenneth W. Bates, Calow, England

[73] Assignee: Injectall Limited, Sheffield, England

[21] Appl. No.: 210,216

[22] Filed: Jun. 17, 1988

Related U.S. Application Data

[63] Continuation of Ser. No. 126,109, filed as PCT GB87/00117 on Feb. 18, 1987, published as WO87/05051 on Aug. 27, 1987, abandoned.

[30] Foreign Application Priority Data

Feb. 20, 1986 [GB] United Kingdom ..... 8604219

[51] Int. Cl.[4] ..... C21C 7/00

[52] U.S. Cl. ..... 75/51.1; 75/53; 75/58; 75/59.1; 266/45; 266/47

[58] Field of Search ..... 75/51.1, 53, 58, 59.1; 266/45, 47

[56] References Cited

U.S. PATENT DOCUMENTS

| | | | |
|---|---|---|---|
| 2,698,749 | 1/1955 | Fishell | 266/34 |
| 2,805,147 | 9/1957 | Schreiber | 75/53 |
| 2,855,293 | 10/1958 | Savard | 75/60 |
| 3,137,753 | 6/1964 | Feichtinger | 75/93 R |
| 3,495,815 | 2/1970 | Holmes | 266/270 |
| 3,539,667 | 11/1970 | Nameishi | 264/56 |
| 3,729,309 | 4/1973 | Kawawa | 75/53 |
| 3,917,240 | 11/1975 | Tanoue | 266/34 T |
| 3,971,548 | 7/1976 | Folgero | 266/218 |
| 4,010,938 | 3/1977 | Crudup | 266/216 |
| 4,108,637 | 4/1978 | Hetke | 75/53 |
| 4,143,211 | 3/1979 | Obinata | 428/650 |
| 4,154,604 | 5/1979 | Gruner | 75/53 |
| 4,266,970 | 5/1981 | Iwaoka | 75/59 |
| 4,295,883 | 10/1981 | Lajh | 75/68 R |
| 4,296,920 | 10/1981 | Miller | 266/216 |
| 4,298,192 | 11/1981 | Barbakadze | 266/218 |
| 4,575,393 | 3/1986 | Bates | 75/53 |
| 4,701,215 | 10/1987 | Bates | 75/58 |

FOREIGN PATENT DOCUMENTS

| | | |
|---|---|---|
| 2633025 | 2/1978 | Fed. Rep. of Germany . |
| 2339 | 1/1953 | German Democratic Rep. . |
| 289128 | 11/1971 | U.S.S.R. . |
| 808145 | 1/1959 | United Kingdom . |
| 1083600 | 9/1967 | United Kingdom . |
| 1119314 | 7/1968 | United Kingdom . |
| 1281012 | 7/1972 | United Kingdom . |
| 1318486 | 5/1973 | United Kingdom . |
| 1351618 | 5/1974 | United Kingdom . |
| 1551451 | 8/1979 | United Kingdom . |
| 1575603 | 9/1980 | United Kingdom . |
| 1594631 | 8/1981 | United Kingdom . |
| 2093169 | 8/1982 | United Kingdom . |
| 2094954 | 9/1982 | United Kingdom . |
| 2102926 | 2/1983 | United Kingdom . |

*Primary Examiner*—Peter D. Rosenberg

*Attorney, Agent, or Firm*—Frishauf, Holtz, Goodman & Woodward

[57] ABSTRACT

Gas injection into a metal melt, accompanied if desired by powdered or solid treatment substances, is by way of a nozzle inserted into the wall of a melt-containing vessel. The nozzle bore initially has a stopper at its inner end and a delivery pipe smaller than the bore is movable therein. Before injection, the pipe and bore adjacent the stopper are cooled by gas. By thrusting the pipe against the stopper while sufficient gas flow and pressure is maintained, the stopper is dislodged and the gas will enter the melt as a jet which leaves the pipe at a injection cooling, then when injection is completed allowing the melt to enter and rapidly freeze locking the pipe safely in the bore.

13 Claims, 1 Drawing Sheet

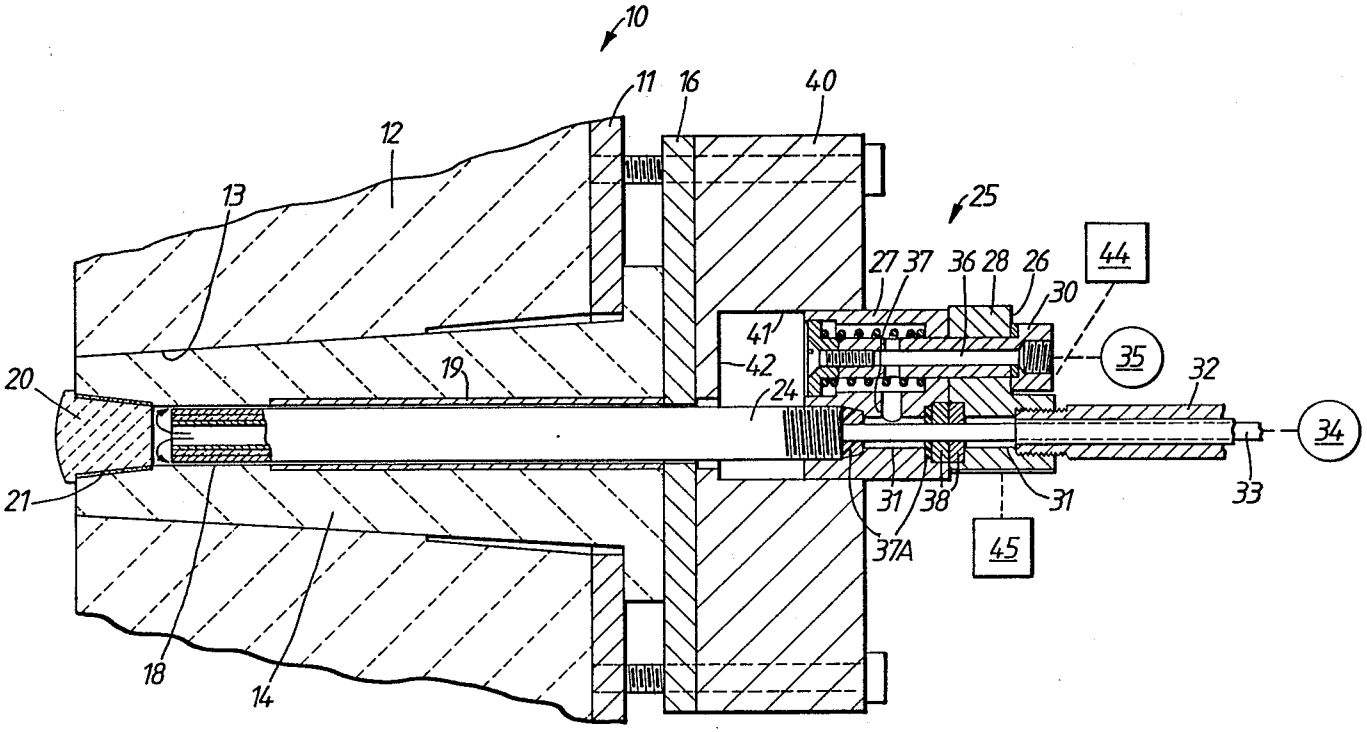
34
33
32
35
44
30
26
28
36
25
37
27
31
45
38
37A
40
41
42
24
16
11
10
19
12
13
14
18
20
21

INJECTION OF SUBSTANCES INTO HIGH TEMPERATURE LIQUIDS

This application is a continuation of application Ser. No. 126,109, filed as PCT GB87/00117 on Feb. 18, 1987, published as WO87/05051 on Aug. 27, 1987, now abandoned.

The present invention relates to injection of substances into high temperature liquids.

More particularly, the invention concerns injecting gases, either alone or in combination with solid or particulate substances into such liquids as molten materials.

Liquids to be treated will ordinarily be at such high temperatures that they may be regarded as aggressive or dangerous. The method and apparatus we disclose herein has been designed to be safe in operation as well as adequately protected from the liquid up to the time treatment is to begin.

Exemplary liquids for treatment include molten slags and metals. Regarding metals, both ferrous and non-ferrous melts may be treated for diverse purposes using the present apparatus. As to ferrous melts, they can be molten iron or steel.

The method and apparatus disclosed hereinafter in detail can be employed in vacuum degassing as a convenient means to introduce alloying additions. Primary and secondary refining, deoxidizing and desulphurizing can be performed to advantage with the aid of the apparatus. Compositions of steels (and other metals) can be controlled or modified by introducing gaseous, solid or powdered substances at any time before solidification. For instance, the melt can be treated in the furnace, in the ingot mould, as well as in vessels such as steelmaking vessels, ladles of various kinds, degassers and tundishes.

Before or during teeming in a metal casting operation, it may be necessary or desirable to introduce gas into the molten metal in a container or vessel. Gas is injected, e.g. into the bottom area of a vessel, for diverse purposes. These include rinsing; clearing the relatively cool bottom area of solidification products, to help remove them from the vicinity of a vessel bottom outlet from which the metal may be teemed; equalising the temperature throughout the melt; and stirring to help disperse alloying additions uniformly in the melt. Usually an inert gas such as argon is used. Reactive gases such as oxygen, carbon dioxide and hydrocarbon gases are sometimes substituted, depending on the melt chemistry.

Previous gas injection proposals have envisaged porous bricks in the refractory lining of a vessel, solid porous plugs in sliding gate teeming valves, and conventional consumable lances. Porous bricks have the virtue of simplicity, but can only be used for gas injection and they may be rendered inoperative if metal slags or metal oxides freeze on it, e.g. between emptying the vessel and refilling it. Moreover, when refilling, these bricks could be damaged, with potentially dangerous consequences, through impact of the molten metal thereon or through thermal shock.

Sliding gate valves adapted for gas injection may be safer, but unless overly complicated they are not able to offer the possibility of gas injection simultaneously with teeming.

Conventional lances are somewhat cumbersome, costly and not without their dangers in view of the splashing their use engenders.

Among other things, the present invention aims to provide an improved gas injection system capable also of introducing powdered materials along with gases. The invention is capable of introducing these substances deep into a metal melt and provides benefits not so readily attainable by the consumable lances conventionally employed.

In ferrous metallurgy, the melt must often be deoxidised and desulphurised by introducing aluminium and calcium or its alloys. Composition control or "trimming" is commonly performed by dissolving solid or powdered alloying additions in the melt. Many materials can be added to melts to overcome the deleterious effects of impurities or to tailor the melts to produce specified compositions. We do not propose to provide an exhaustive catalogue of possible treatment materials. The choice of materials will depend on the melts, their starting and finishing compositions; it is well within the purview of the works chemist or metallurgist to choose appropriate addition(s) as each situation demands. Introducing additions to a steel melt—or indeed any other metal melt—can be troublesome especially if the alloying addition is readily melted, oxidised or vaporised. Thus, adding aluminium to a steel melt can be a difficult operation in view of the low melting point of aluminium. No significant deoxidation would be achieved if the aluminium were simply dumped onto the melt: it has to be delivered deep into the melt so it has time to liquify and react rather than float ineffectively on top of the melt. Calcium moieties have to be fed deep into the melt. Previous delivery methods include use of a lance or sophisticated and expensive equipment for firing the alloying addition deep into the melt. Lancing is apparently simple but has drawbacks as intimated above.

The present invention also provides improvements relating to the introduction of solid strands or wires of alloying additions to the melt.

The invention involves injecting substances through the wall of a vessel at a location deep into the liquid where the hydrostatic pressure is significant. Due to the prevailing pressures, leakage is possible and equipment provided for delivering the chosen substance (s) to the liquid could be ejected from the vessel wall unless relatively elaborate precautions are taken. The present invention addresses such safety-related problems as these. It also seeks to inject substances in a manner that maximises the effectiveness of contact between the injected substances and the liquid.

According to the present invention, there is provided a method of injecting gas into a high temperature melt via a passage through the wall of a vessel containing the melt, the passage initially having a dislodgeable stopper closing its inner end, comprising the steps of:

(a) from outside the vessel, inserting a delivery pipe into the passage and disposing an inner end of the pipe adjacent the stopper, the pipe being smaller transversely than the passage by a predetermined amount;

(b) cooling the pipe and passage in the vicinity of the stopper by passing gas along the pipe and exhausting the gas to the exterior of the vessel;

(c) immediately before injecting gas into the melt, establishing gas pressure and flow rate in the tube of sufficient magnitudes that, upon injection, the gas velocity leaving the pipe is great enough to ensure the gas enters the melt as a jet rather than as bubbles;

(d) forcibly thrusting the pipe at the stopper, dislodging the stopper into the melt and thereby commencing injection of gas into the melt;

(e) maintaining substantially undiminished the gas pressure and flow rate during the ensuing injection; and (f) when the injection is adjudged complete, reducing the gas pressure/flow rate and allowing the melt to enter and freeze in the pipe thereby closing it, the amount by which the pipe is smaller than the passage affording a space therebetween large enough for the melt to intrude for a limited distance, before freezing, as soon as the stopper is dislodged.

Beneficially, the gas pressure and flow rate establish a gas velocity leaving the pipe in excess of Mach 0.5, e.g. Mach 0.5 to 0.7.

Conveniently, but not essentially, the gas to be injected is also used for the cooling step.

Gas alone can be injected. Gas and non-gaseous substances can also be injected, the non-gaseous substances being particulate or a solid strand. A solid strand is in the form of a wire, rod or a tubular sheath enclosing a dense packing of particulate matter.

To terminate injection most conveniently, a shut-off mechanism can be fitted to the exterior end of the pipe, said mechanism being operable to discontinue instantaneously the supply of gas and/or the supply of non-gaseous substance which may have been injected with the gas. The pipe and shut-off mechanism can constitute apparatus as disclosed in our British patent specification No. GB-A-2,171,186, the entire disclosure of which is incorporated herein by this reference.

If gas plus a solid strand are to be injected, it may be beneficial to fit an obturator in the delivery pipe, at its inner or downstream end. Examples of obturators are disclosed in our British patent specification No. GB-A-2,171,117, the disclosure of which is incorporated herein by this reference.

The present method can be performed using apparatus possessing one or, optionally, more than one injection passage. For operational flexibility, the presence of several injection passages may be considered desirable. Our patent publication No. WO 84/02147 discloses apparatus embodiments which can readily be adapted for practising the present invention, and the disclosure of WO 84/02147 is incorporated herein by this reference.

The invention comprehends apparatus constructed and arranged to operate so as to perform the above-defined method, as well as methods of producing metals or alloys involving the use of the above-defined method, and the resulting metals or alloys themselves.

The invention will now be described in more detail by way of example only with reference to the accompanying drawing, the sole figure of which shows, in longitudinal cross section, apparatus adapted for practising the present method, said apparatus being shown installed in the wall of a vessel such as a ladle.

In the accompanying drawing, 10 is a ladle or other vessel for containing a metal melt. Vessel 10 has a metal shell 11 lined with refractory 12. The shell 11 has an aperture and conincident therewith the refractory lining 12 has a tapered opening 13 extending throughout its thickness. A refractory nozzle insert 14, tapered to match the opening 13 is installed therein from outside the vessel. A clamp plate 16, bolted to the shell 11 or to an adaptor plate (not shown) secured thereto, holds the nozzle insert 14 in place in the opening 13. The nozzle insert 14 may be affixed in the opening with cement to guard against leakage, the cement being frangible to allow for removal of the insert for replacement.

An injection passage 18 pierces the nozzle insert 14 from end to end, the passage 18 in part being lined with a reinforcing metal sleeve 19. At the inner end, the passage 18 is enlarged and is blocked by a dislodgeable refractory stopper 20. The stopper is held in place by a weak cement or mastic 21. Thanks to the stopper 20, melt cannot enter the passage 18 prior to injection.

For delivering gas, or gas plus a powder substance or gas plus a solid substance to the melt, a delivery pipe 24 is located in the passage 18. Before injection commences, the pipe 24 has its inner or downstream end set back a short way from the adjacent end of the stopper 20, e.g. by 10 mm or so. The pipe is longitudinally movable in the passage 18. The pipe 24 has a bore of e.g. 10 mm and is of composite structure. It has concentric inner and outer tubes: the outer metal, the inner mullite, and has an insulating packing e.g. a cement therebetween. The pipe 24 projects outwardly from the nozzle insert 14 and is screw-threaded to a shut-off mechanism 25 comprising a two part lance or inlet head 26.

Inlet head 26 can incorporate the features disclosed in more detail in British patent specification No. GB-A-2,171,186. This particular inlet head 26 is for the injection of gas and wire. Head 26 comprises inner and outer head members 27, 28 held together by a pivot bolt means 30 and a shearable fastener (not shown). Together, the members define a main duct 31. At one end, duct 31 communicates with the pipe 24 and at the other end with a wire conduit 32 secured to outer head member 28. Wire 33 for injection is lead by conduit 32 from a wire feeder 34 to the inlet head 26. The wire is passed down the duct 31 into the pipe 24; the wire is necessarily smaller than the bore of the pipe 24. Outer head member 28 has a connection for a gas conduit leading to a gas supply 35. The connection conveniently is part of the pivot bolt means 30 which is suitably bored at 36, for conveying gas to a cross passage 37 in inner head member 27. The cross passage 37 leads to the duct 31 in the inner head member. Seals 37A, through which the wire 33 is threaded, prevent gas entering the duct 31 from cross passage 37 escaping significantly therefrom. The pivotal connection of the two head members 27, 28 permits the outer head member 28 to be so displaced that the sections of duct 31 in the two members 27, 28 are moved out of alignment. For this to be possible, the wire 33 must be severed at the interface of the members 27, 28 and hence the members include coacting shear bushes 38 of the interface.

The inlet head having the pipe 24 secured thereto is located in a seating block 40 attached to plate 16. Seating block 40 has a well 41 slidably receiving the inner head member 27. Before injection commences, the inner end of member 27 is spaced from the bottom 42 of the well and, as stated earlier, the pipe 24 is set back from the stopper 20. An actuator 44, e.g. a hydraulic ram, is suitably coupled to the inlet head 26 for thrusting it and the pipe to the left as shown in the drawing. The actuator 44 is operated, when injection is to commence, to force inlet head member 27 to bottom out in the well 41 and to force the pipe 24 to thrust the stopper 20 out of passage 18 and into the melt. A safety stop (not shown) guards against inadvertent displacement of the head 26 and pipe 24.

When injection is to cease, another actuator 45 is operated to displace outer head member 28 about the pivot bolt means 30 relative to inner head member 27. Actuator 45 may again be a hydraulic ram. When activated, shearing of the wire occurs and its movement towards the melt ceases. In this design, gas will continue to flow into the pipe 24 after operation of actuator 45 and hence a valve, not shown, would be closed to terminate gas injection.

Of course, if the cross-passage 37 were located in the outer head member 28, displacement of the latter by actuator 45 would terminate both the gas and wire feeds.

If gas alone, or gas plus a powdered substance were to be injected, a simpler version of inlet head 26 could be used. For example, the head can still comprise pivotally-interconnected inner and outer head members, but they would provide only one duct leading from a gas/-powder conduit to the pipe 24. In this case, operation of actuator 44 would serve the same purpose as before (initiating injection) and operating of actuator 45 would terminate gas or gas plus powder feeding as the portion of the duct in the outer head member is moved out of alignment with the companion duct portion in the inner head member.

Before initiating an injection, the pipe is set back as aforesaid and it, as well as the passage 18 in the vicinity of the stopper, are cooled by means of gas, e.g. the gas to be injected later. The pipe 24 is of a smaller outside diameter than the bore of the passage 18, and gas under pressure fed down the pipe can travel back along the pipe to exhaust to the exterior of the vessel 10. The gap or clearance between the pipe and the passage is governed in part by the cooling desired, and in part by a wish for melt later to enter and freeze in the gap. Cooling will be optimised if the gas flow cross section down the pipe is less than the gas exhaust flow cross section back outside the pipe, since the resulting decompression has a cooling effect. In the apparatus shown, the pipe has a bore of 10 mm (area 78.5 $mm^2$) and the clearance cross section is about 120 $mm^2$, i.e. the latter cross section is about 50% larger than the bore cross section. The pipe outside diameter is about 80% to about 90% of the passage diameter and the width of the gap (measured radially) is in the range of 0.5 to 2 mm, e.g. 1.35 mm. Thus, the pipe 24 has an outside diameter of 27 mm and the passage 18 has a bore of 29.7 mm. The invention is not limited to the foregoing dimensional characteristics, which only apply to the particular design illustrated. Clearly, the dimensions may be varied consistent with the desires to obtain adequate cooling and to have melt enter and freeze in the aforesaid gap. Some melts (e.g. iron melts) are more mobile than others (e.g. steel melts) and the more mobile a melt, the smaller the gap it will successfully penetrate.

In the case of wire injection, the pre-injection cooling will be such as to ensure the wire cannot melt in the pipe 24.

The gas flow rate and pressure for pre-injection cooling can be selected as practical experience demands. For example, they can be such as to produce a flow velocity from the tube 24 of about Mach 0.5 or more. In the case of wire injection, the gas will desirably be inert or non-oxidising to protect the wire from oxidation before injection commences. Just before injection starts, another gas may be substituted for the cooling gas.

Immediately before actuator 44 is operated to initiate injection, the gas flow rate and pressure are set at levels such that the gas will jet rather than bubble into the melt, and these levels are maintained substantially undiminished throughout the injection. Jetting is beneficial insofar as it ensures efficient mixing of the gas, and e.g. powder carried thereby, with the melt occurs. Bubbling is distinctly disadvantageous, since bubbles may cling to the vessel wall and hence not mix adequately with the melt. Moreover, when a bubble collapses i.e. leaves the pipe 24, an instantaneous suction effect occurs whereby the melt may be sucked into the pipe 24 and block it.

We have found that the flow rate and pressure should be such as to establish a gas velocity out of the pipe of Mach 0.5 or greater, for instance Mach 0.6 to 0.7 or more. By way of example, the gas pressure can range from 35 to 150 psi (2.4 to 10.3 bar) and the flow rate may be 10 to 65 CFM (17 to 111 $m^3/h$) at the prevailing pressure.

Injection commences when actuator 44 thrusts inlet head 26 and pipe 24 in the direction of the melt to dislodge the stopper 20. At the outset, melt enters the gap between the passage 18 and the pipe 24. Thanks to the pre-injection cooling, the melt entering the gap quickly freezes. Freezing of melt in the gap is important for safety reasons, because it can lock the pipe 24 in place. Thus, should pressure in actuator 44 fail for any reason, the metallostatic head at the nozzle insert 14 will be unable to expel the locked or frozen pipe 24 from the passage 18.

There is necessarily a falling temperature gradient from the inner to the outer end of the nozzle insert 14. This gradient, plus the effectiveness of pre-injection cooling the melt visocity and the size of the gap are the main factors in determining how far the melt will penetrate the gap before it freezes therein. In practice, the melt may penetrate only a limited distance, for instance about 50 mm into the gap before freezing. Clearly, then, there is no danger of the melt leaking from the vessel 10 via the gap.

When injection is to cease, the actuator 45 is operated to shear the wire and the wire feeder 34 is stopped. Gas from the supply 35 can then be shut off.

When the gas pressure in pipe 24 drops sufficiently, to less than the metallostatic head, melt will enter the pipe 24. Because the pipe has been kept cool by the flowing gas and because of the aforesaid temperature gradient, the melt will not be able to escape from the vessel by way of the pipe. After traversing the pipe for a limited distance, the melt will freeze therein thus ensuring no escape is possible.

The apparatus shown in the drawing has a nozzle insert 14 pierced by a single nozzle passage 18. If desired, the insert can be made larger, to accommodate 2, 3, 4 or more injection passages, each of which will be furnished with stoppers and suitable delivery pipes. Outboard of the shell 11, the apparatus will have extra mechanical parts and actuators 44, 45 to permit or expedite injection via successive pipes. If desired, it can be arranged that injection takes place simultaneously from a plurality of pipes.

Industrial Applicability

The invention is applicable for safely introducing gases to aggressive or dangerous melts which are at high temperatures, such as molten metals. The invention can, for instance, be used in ferrous metallurgy for introducing gases into molten steel or iron, for various purposes, and non-gaseous substances can be introduced simultaneously with a gas, such substances for instance being in the form of a strand or a powder. Thus, using the invention one can introduce alloying elements, especially readily volatilisable elements such as aluminium and potentially hazardous, volatilisable elements such as lead. Substances used for grain refinement or for controlling carbide formation can be introduced similarly. Likewise, the invention can be used to introduce substances used e.g. to desulphurise, desiliconise or dephosphorise the melt.

I claim:

1. A method of injecting gas into a high temperature melt via a passage through the wall of a vessel containing the melt, the passage initially having a dislodgeable stopper closing its inner end, comprising the steps of:

(a) from outside the vessel (10), inserting a delivery pipe (24) into the passage (18) and disposing an inner end of the pipe adjacent the stopper (20), the pipe being smaller transversely than the passage by a predetermined amount;

(b) cooling the pipe (24) and passage (18) in the vicinity of the stopper (20) by passing gas along the pipe and exhausting the gas to the exterior of the vessel (10);

(c) immediately before injecting gas into the melt, establishing gas pressure and flow rate in the pipe (24) of sufficient magnitudes that, upon injection, the gas velocity leaving the pipe is great enough to ensure the gas enters the melt as a jet rather than as bubbles;

(d) forcibly thrusting the pipe (24) at the stopper (20), dislodging the stopper into the melt and thereby commencing injection of gas into the melt;

(e) maintaining substantially undiminished the gas pressure and flow rate during the ensuing injection; and (f) when the injection is adjudged complete, reducing the gas pressure/flow rate and allowing the melt to enter and freeze in the pipe (24) thereby closing it, the amount by which the pipe (24) is smaller than the passage (18) affording a space therebetween large enough for the melt to intrude for a limited distance, before freezing, as soon as the stopper (20) is dislodged.

2. A method according to claim 1, wherein the gas pressure and flow rate establish a gas velocity leaving the pipe in excess of Mach 0.5, e.g. Mach 0.5 to 0.7.

3. A method according to claim 1, wherein the pipe and passage are of circular cross section and the pipe has a diameter about 80% to about 90% of the passage diameter.

4. A method according to claim 1, wherein the said space is annular and its width is in the range of 0.5 to 2 mm.

5. A method according to claim 1, wherein the pipe has an internal diameter of 10 mm and the said space has a cross-sectional area of about 120 $mm^2$.

6. A method according to claim 1, wherein the pipe and the passage are cooled by passing gas internally along the pipe toward the stopper and then back externally along the pipe to the exterior.

7. A method according to claim 1, wherein the gas to be injected is used for cooling the pipe and the passage, and the same pressure and flow rate are used for cooling as for injecting into the melt.

8. A method according to claim 1, wherein a non-gaseous melt-treatment substance is injected into the melt along with said gas.

9. A method according to claim 8, wherein said substance is of particulate form.

10. A method according to claim 8, wherein said substance is in the form of a wire or rod for dissolving in the melt.

11. A method according to claim 1, wherein a shut-off mechanism (27, 28) is fitted to an exterior end of the pipe (24) and is operated to discontinue, instantaneously, the supply of at least one of gas and the non-gaseous melt-treatment substance to the pipe when injection is to be terminated.

12. A method according to claim 1, wherein the melt is a metal melt and at least one of gas and the gas plus treatment substance, is or are injected to control, vary or adjust the metallurgical properties of the metal.

13. A method according to claim 2, wherein the pipe and passage are of circular cross section and the pipe has a diameter about 80% to about 90% of the passage diameter.

* * * * *